US012098511B2

(12) United States Patent
Harman et al.

(10) Patent No.: US 12,098,511 B2
(45) Date of Patent: Sep. 24, 2024

(54) BOLLARD SLEEVE WITH REMOVABLE OR REPLACEABLE LID

(71) Applicant: 1-800-BOLLARDS, INC., Irvine, CA (US)

(72) Inventors: Frank Harman, La Habra, CA (US); Joe Pederson, Lake Forest, CA (US)

(73) Assignee: 1-800-BOLLARDS, INC., Irvine, CA (US)

( * ) Notice: Subject to any disclaimer, the term of this patent is extended or adjusted under 35 U.S.C. 154(b) by 0 days.

(21) Appl. No.: 17/821,124

(22) Filed: Aug. 19, 2022

(65) Prior Publication Data

US 2024/0060255 A1 Feb. 22, 2024

(51) Int. Cl.

| | |
|---|---|
| ***E01F 9/685*** | (2016.01) |
| ***E01F 9/60*** | (2016.01) |
| ***E01F 9/646*** | (2016.01) |
| ***E01F 13/02*** | (2006.01) |
| ***E01F 13/04*** | (2006.01) |

(52) U.S. Cl.

CPC ..... *E01F 9/685* (2016.02); *E01F 9/60* (2016.02); *E01F 9/646* (2016.02); *E01F 13/026* (2013.01); *E01F 13/044* (2013.01)

(58) Field of Classification Search

CPC ..... E01F 15/003; E01F 13/046; E01F 13/026; E01F 13/024; E01F 9/685; E01F 13/04; E01F 13/044; E01F 9/646; E01F 9/60; E04H 12/2269; H02G 3/14; E05D 7/12; E05D 7/10; E05D 5/12; E05D 7/1061; E02D 29/1463

USPC ..... 49/131

See application file for complete search history.

(56) References Cited

U.S. PATENT DOCUMENTS 2,277,549 A * 3/1942 Jervis ..... E05D 7/12 16/384
2,315,516 A * 4/1943 Gray ..... E01F 13/04 52/298
2,778,053 A * 1/1957 Hess ..... E05D 7/12 248/666

(Continued)

FOREIGN PATENT DOCUMENTS

DE 0724896 A1 * 8/1996 ..... E01F 9/677
GB 2214210 A * 8/1989 ..... E01F 13/046

(Continued)

OTHER PUBLICATIONS

Trafficguard, Inc. (Jul. 31, 2014). Locking removable round post RPL6 vehicle impact barricades [Video]. YouTube. https://www.youtube.com/watch?v=EZU2hROwR2Q (Year: 2014).*

*Primary Examiner* — Taylor Morris
(74) *Attorney, Agent, or Firm* — Knobbe, Martens, Olson & Bear, LLP

(57) ABSTRACT

A bollard sleeve with a removable or replaceable cover is described. In one example, the bollard sleeve includes a cover portion and a sleeve portion coupled to the cover portion. The cover portion can have a cover removably coupled to a skirt, and the sleeve portion can have a tab. When the tab is in a first position, the tab can prevent the cover from being removed. When the tab is in a second position, the tab can form an opening that allows the cover to be removed. The tab can be bent from the first position to the second position, or the tab can be removed from the sleeve portion.

21 Claims, 8 Drawing Sheets

(56) References Cited

U.S. PATENT DOCUMENTS 3,021,555 A * 2/1962 Hogedal ..... E05D 7/083 16/388
3,130,651 A * 4/1964 Werner ..... E02D 29/14 49/389
3,205,531 A * 9/1965 Amos ..... E05D 7/1061 312/208.6
3,423,786 A * 1/1969 Henry, Jr. ..... E05D 7/123 16/382
3,455,059 A * 7/1969 Evans ..... E02D 29/1463 49/402
3,488,793 A * 1/1970 Turpen ..... B62D 33/03 16/263
3,660,935 A * 5/1972 Boots ..... E01F 13/046 49/35
3,709,188 A * 1/1973 Coupar ..... E01F 9/685 411/969
3,857,575 A * 12/1974 Lee ..... B60D 1/66 52/297
4,576,508 A * 3/1986 Dickinson ..... E01F 13/046 404/11
4,672,714 A * 6/1987 Bos ..... E05D 7/1061 16/262
4,873,745 A * 10/1989 Ramsauer ..... E05D 7/1061 16/259
4,919,563 A * 4/1990 Stice ..... E01F 13/046 404/6
5,192,159 A * 3/1993 Higginson ..... E01F 13/046 404/11
5,193,308 A * 3/1993 Davidian ..... E05D 7/12 16/382
5,231,732 A * 8/1993 Knoop ..... E05D 7/1066 16/254
5,507,590 A * 4/1996 Argandona ..... E02D 29/1418 49/386
5,961,249 A * 10/1999 Hansen ..... E01F 13/026 49/35
5,975,792 A * 11/1999 Goeken ..... E01F 13/046 49/133
6,105,809 A * 8/2000 Yamanaka ..... A47J 36/06 220/592.27
6,352,295 B1 * 3/2002 Leitner ..... E05D 11/1064 16/296
6,409,419 B1 * 6/2002 Hernandez ..... E01F 13/04 404/6
6,454,444 B1 * 9/2002 Wang ..... E05D 7/1061 16/268
6,821,050 B1 * 11/2004 Maldonado ..... E01F 13/046 404/6
7,341,398 B2 * 3/2008 Johnson ..... E02D 29/1418 220/816
7,472,891 B2 * 1/2009 Schram ..... E05B 53/00 256/65.14
7,744,304 B2 * 6/2010 Akkala ..... E02D 29/1463 404/25
7,761,958 B2 * 7/2010 Alfredsson ..... E05D 7/1066 16/261
8,017,865 B1 * 9/2011 Baldwin ..... H02G 3/14 174/67
8,297,873 B1 * 10/2012 Schram ..... E01F 9/685 40/607.04
10,017,973 B2 * 7/2018 Höschler ..... E05D 7/1061
10,590,687 B1 * 3/2020 Cifers ..... E05D 7/12
2007/0241026 A1 * 10/2007 Green ..... A47B 47/00 206/579
2008/0063470 A1 * 3/2008 Bousson ..... E01F 13/026 404/6
2011/0088217 A1 * 4/2011 Bjorn ..... E05B 3/00 16/382

FOREIGN PATENT DOCUMENTS

GB 2299604 A * 10/1996 ..... E01F 13/026
GB 2305199 A * 4/1997 ..... E01F 13/046
GB 2339586 A * 2/2000 ..... E01F 13/046
GB 2346640 A * 8/2000 ..... E01F 13/046
GB 2346642 A * 8/2000 ..... E01F 13/046
KR 200305575 Y1 * 2/2003 ..... E01F 15/003
WO WO-9002860 A1 * 3/1990 ..... E01F 9/685

* cited by examiner

BOLLARD SLEEVE WITH REMOVABLE OR REPLACEABLE LID

BACKGROUND

Field

The present application relates to bollard sleeves in general, and more particularly, embodiments of the present application relate to bollard embedment sleeves with a removable or replaceable cover or lid.

Description

Conventional bollard embedment sleeves are inserted into the ground and designed to hold bollards upright. Typically, bollard embedment sleeves include a cover or lid that covers the hole the bollard is inserted into. The cover or lid is typically not removable from the rest of the bollard embedment sleeve. When the bollard is inserted into the bollard embedment sleeve, the cover or lid typically rests against the side of the bollard. In some cases, the cover or lid is coupled to the bollard to secure the bollard to the bollard embedment sleeve. Since bollards can be used to block cars or other vehicles, if a car or other vehicle contacts the bollard, the force may damage the cover or lid of the bollard embedment sleeve rendering the bollard embedment sleeve unusable. When the cover or lid is damaged, since the cover or lid is not removeable, the entire bollard embedment sleeve may have to be removed from the ground and replaced with an undamaged bollard embedment sleeve. Replacing the entire bollard embedment sleeve can require significant labor and material costs.

Accordingly, there is a need for an improved bollard embedment sleeve that includes a removable cover or lid that can be removed and/or replaced while the rest of the bollard embedment sleeve remains securely in the ground.

SUMMARY

In some configurations, a bollard sleeve configured to receive a bollard can include: a top portion including a skirt and a cover rotatably coupled to the skirt; and a sleeve portion coupled to the top portion, the sleeve portion including a cover securement portion, wherein the cover securement portion includes a first position and a second position, and wherein the cover is non-removable when the cover securement portion is in the first position, and the cover is removeable when the cover securement portion is in the second position.

In some configurations, the cover can be removable when the sleeve portion is underground.

In some configurations, the sleeve portion can include a top end coupled to the top portion and a bottom end opposite the top end, and the cover securement portion can include a tab at the top end of the sleeve portion.

In some configurations, the sleeve portion can include a recess on either side of the tab, and a top of the tab is a same height as the top end of the sleeve portion.

In some configurations, the cover can include a hinge portion in contact with a bottom of the skirt, and the cover can rotate about the hinge portion.

In some configurations, the tab can be substantially parallel to a sidewall of the sleeve portion when in the first position and the tab is bent at an angle to the sidewall when in the second position.

In some configurations, the tab can be coupled to the sleeve portion when in the first position and the tab can be decoupled from the sleeve portion when in the second position.

In some configurations, the bollard sleeve can include at least one support coupled to the top portion and the sleeve portion.

In some configurations, the bollard sleeve can include at least one cavity coupled to the sleeve portion, the at least one cavity configured to receive a portion of a lock of the bollard, wherein the bollard is secured to the bollard sleeve when the at least one cavity receives the portion of the lock of the bollard.

In some configurations, the bollard sleeve can include at least one of steel, stainless steel, and/or carbon steel.

In some configurations, a bollard sleeve configured to receive a bollard can include: a top portion including a skirt and a cover rotatably coupled to a bottom surface of the skirt; a sleeve portion coupled to the top portion, the sleeve portion including a tab; and two cavities coupled to the sleeve portion, the two cavities configured to each receive a portion of a lock of the bollard, wherein the bollard is secured to the bollard sleeve when the two cavities receive the portion of the lock of the bollard, wherein the tab includes a first position and a second position, and wherein the cover is non-removable when the tab is in the first position, and the cover is removeable when the tab is in the second position.

In some configurations, the sleeve portion can include a recess on either side of the tab, and a top of the tab is a same height as a top end of the sleeve portion.

In some configurations, the tab can be substantially parallel to a sidewall of the sleeve portion in the first position, and the tab can be bent at an angle in the second position.

In some configurations, the tab can be coupled to the sleeve portion when in the first position and the tab can be decoupled from the sleeve portion when in the second position.

In some configurations, a method of replacing a bollard sleeve cover can include: moving a cover securement portion of a sleeve portion of a bollard sleeve from a first position to a second position; rotating the bollard sleeve cover about a vertical axis to release a portion of the bollard sleeve cover from a skirt portion of the bollard sleeve; removing the bollard sleeve cover through an opening configured to receive a bollard; inserting a second bollard sleeve cover through the opening; and rotating the second bollard sleeve cover to secure the second bollard sleeve cover to the skirt portion of the bollard sleeve.

In some configurations, the cover securement portion can include a tab.

In some configurations, the tab can be substantially vertical when in the first position and the tab can be bent when in the second position.

In some configurations, the method can include moving the cover securement portion from the second position to the first position.

In some configurations, the first position can include the cover securement portion coupled to the sleeve portion, and the second position can include the cover securement portion decoupled from the sleeve portion.

In some configurations, the bollard sleeve can be underground.

BRIEF DESCRIPTION OF THE DRAWINGS

These and other features, configurations, and advantages of the present disclosure are described with reference to the drawings of certain embodiments, which are intended to schematically illustrate certain embodiments and not to limit the disclosure.

DETAILED DESCRIPTION

These and other features, configurations, and advantages of the present disclosure are described with reference to the drawings of certain embodiments, which are intended to schematically illustrate certain embodiments and not to limit the disclosure.

Figure 1:
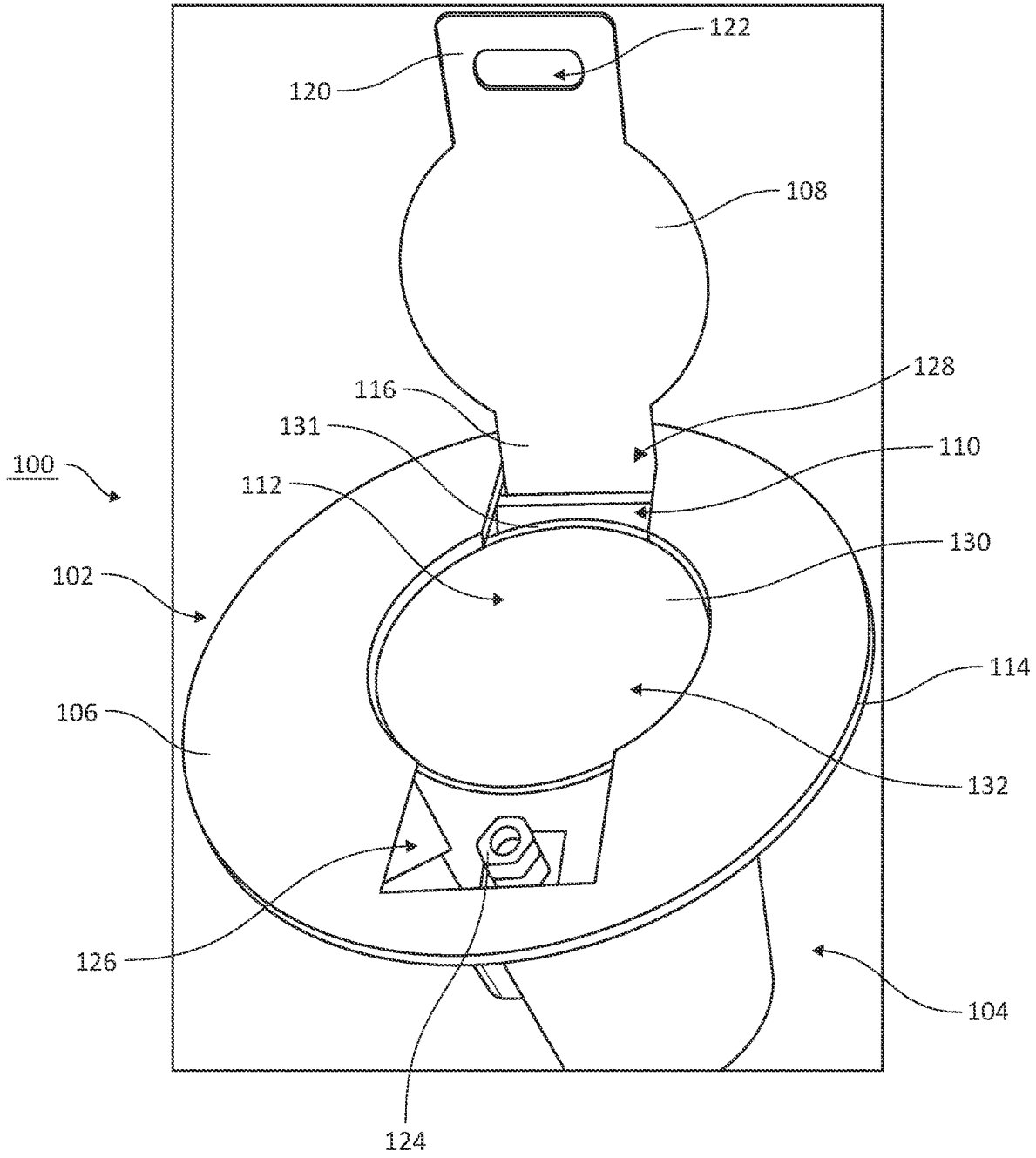
FIG. 1 illustrates an example of an existing bollard sleeve.

FIG. 1 illustrates an example of a prior art bollard sleeve 100. The bollard sleeve 100 can include a top portion 102 and a sleeve portion 104. The top portion 102 can include a skirt 106 and a cover 108. The skirt 106 can be a substantially flat piece of material. The skirt 106 can include a perimeter 114. The perimeter 114 can include a shape. In some cases, the shape of the perimeter 114 can be a circle or substantially a circle. In some cases, the shape of the perimeter 114 can be an oval, a square, a rectangle, or any other shape. The skirt 106 can include an opening 112. The opening 112 can be located substantially in the center of the skirt 106. The opening 112 can be configured to receive a bollard and can be substantially a same shape and size as a cross section of the bollard. The bollard can be inserted into the bollard sleeve through the opening 112. In some cases, the skirt 106 can include a latch opening 126 and a hinge opening 128. The latch opening 126 and the hinge opening 128 can be coupled to the opening 112 such that the opening 112, the latch opening 126, and the hinge opening 128 form a single opening or single cut out in the skirt.

The cover 108 can include a hinge portion 116 and a latch portion 120. The cover 108 can be substantially the same shape as the single opening or cut out in the skirt formed by the opening 112, the latch opening 126 and the hinge opening 128. The cover 108 can be rotatably coupled to the skirt 106 via the hinge portion 116. The cover 108 can rotate from an open position and a closed position. When the cover 108 is in the open position and a bollard is within the opening 112 and within the sleeve portion 104, a bollard can be coupled to the cover 108 via an opening 122 on the latch portion 120. A lock or other securement mechanism can be inserted through the opening 122 and coupled to a portion of the bollard. When the cover 108 is in the closed position, the cover 108 can cover substantially the entire opening 112, latch opening 126 and hinge opening 128. In some cases, the cover 108 can be coupled to a nut 124 or any other securement mechanism. The nut 124 can be coupled to the sleeve portion 104 such that when a bolt is inserted through the opening 122 and the latch opening 126, the bolt can be coupled to the nut 124, and the bolt and the nut 124 can secure the cover 108 in the closed position.

The sleeve portion 104 can be a tube-shaped piece of material with substantially a same cross-section as a cross-section of the bollard. In some cases, sleeve portion 104 can have a circular cross-section. In some cases, a top end 110 of the sleeve portion 104 can be coupled to the top portion 102 such that when the bollard is inserted into the opening 112, the bollard extends into an inner volume 132 of the sleeve portion 104. A sidewall 130 of the sleeve portion 104 can contact the bollard when the bollard extends into the inner volume 132 to hold the bollard substantially vertically. The sidewall 130 of the sleeve portion 104 can form a border 131 between the opening 112 and the latch opening 126, and the opening 112 and the hinge opening 128. The sleeve portion 104 can be configured to be inserted underground or into a hole such that the top portion 102 is substantially planar with a surface of a road, sidewalk, or other surface.

FIGS. 2A-4 illustrate an example of a bollard sleeve 200 with a removable cover. The bollard sleeve 200 can include a sleeve portion 204 with a cover securement portion or tab 202 at a top end 210 of the sidewall 230. In some cases, the tab 202 can be formed by one or more recesses or cutouts 205 in the sidewall 230 on either side of the tab 202. The tab 202 may be located such that the tab 202 forms a portion of the border 231 between the opening 212 and the latch opening 226. In some cases, as shown in FIG. 3A, the sleeve portion 204 can include a depth 203. The depth 203 can be about 12 inches to about 36 inches.

Figure 2A:
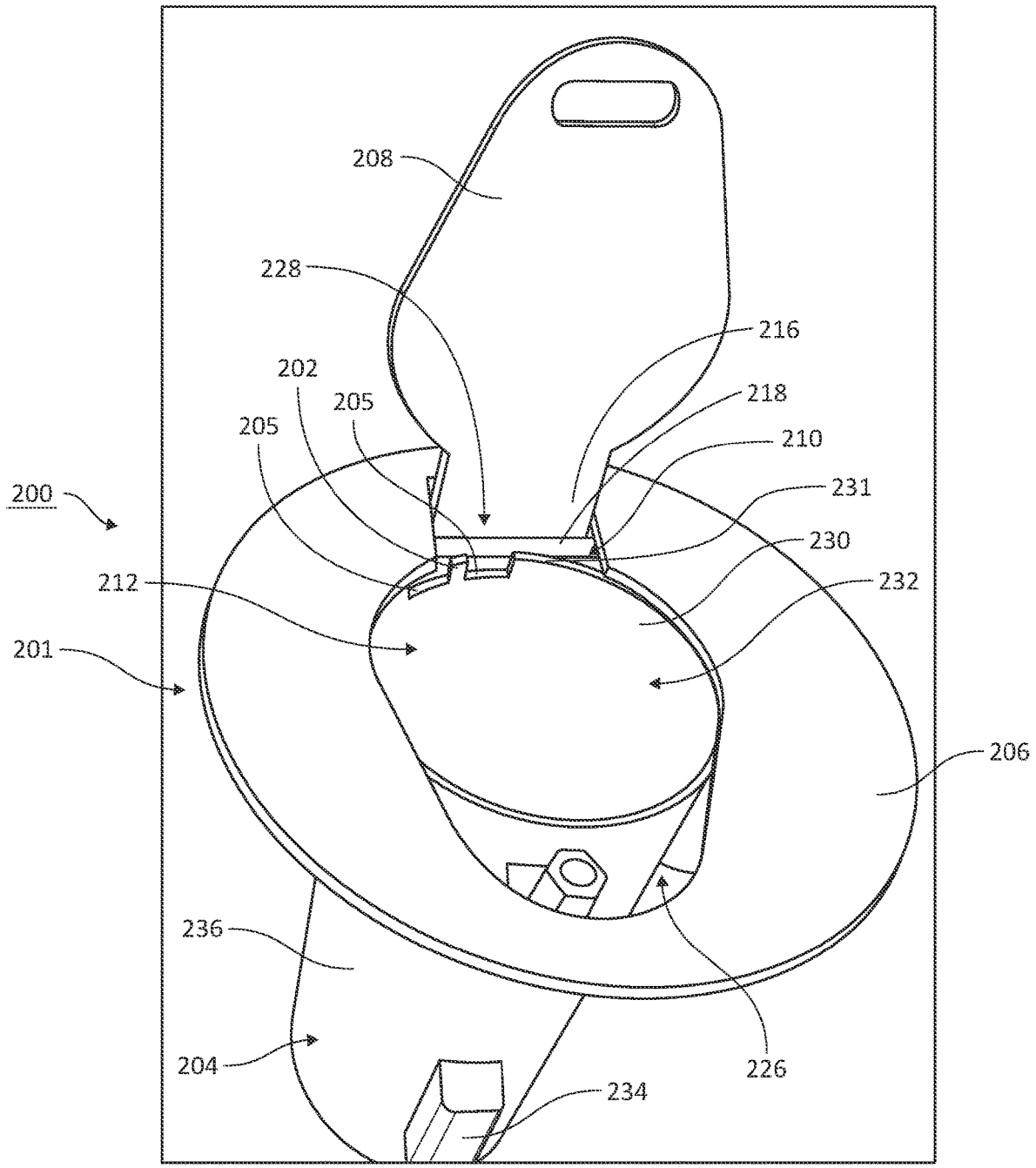
FIGS. 2A-2B illustrate example of a bollard sleeve with a removable cover.

In some cases, the cover 208 can be rotatably coupled to the skirt 206 via a hinge portion 216. The hinge portion 216 can include a hinge 218. As best shown in FIG. 3B, a bottom view of a top portion 201, the hinge 218 can include a width 220. The width 220 can be greater than a width 221 of the hinge opening 228. The cover 208 can be inserted into the hinge opening 228 such that the hinge 218 contacts a bottom surface 222 of the skirt 206. In this way, the hinge 218 prevents the cover 208 from being removed through the hinge opening 228. The cover 208 can rotate from an open position, shown in FIG. 2A, to a closed position, shown in FIG. 3A. As shown in FIG. 2A, the hinge 218 can translate along the bottom surface 222 (shown in FIG. 3B) of the skirt 206 such that the cover 208 can translate from a distal end 224 (shown in FIG. 4) of the latch opening 226 to the border 231. In some cases, the tab 202 and the border 231 can prevent the cover 208 from translating from the hinge opening 228 and into the opening 212. In some cases, the hinge 218 can be coupled or connected to the bottom surface 222. In other cases, the hinge 218 can be a floating hinge that is contained under the bottom surface 222 of the skirt 206 in the hinge opening but is not coupled or connected to the bottom surface 222.

Figure 4:
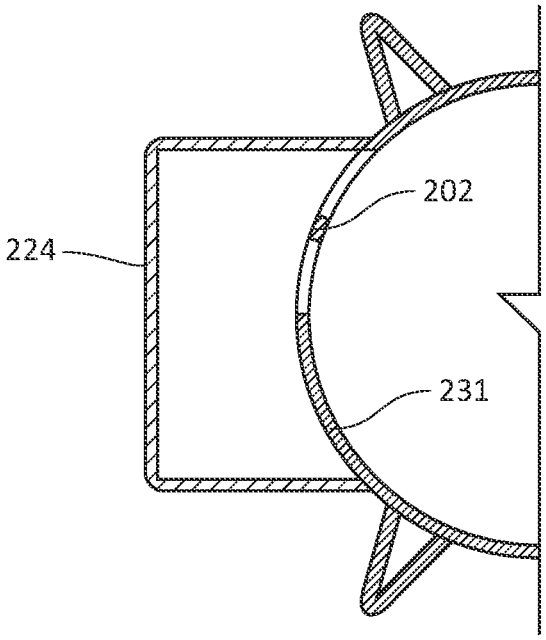
FIG. 4 illustrates a top view of a tab of a bollard sleeve with a removable cover.

The tab 202 can be repositioned from a first position to a second position when the bollard is not in the bollard sleeve 200. As shown in FIG. 4, a top view of the sleeve portion 204, the tab 202 can be substantially vertical or substantially parallel to the sidewall 230 of the sleeve portion 204 when the tab 202 is in the first position. In other words, the tab 202 can be unbent when the tab 202 is in the first position. As shown in FIG. 2C, in some cases, the tab 202 can be bent from the first position to the second position to form an angle with the sidewall 230. In these cases, a tab 202 that remains connected to the sidewall 230 can reduce the possibility of the tab 202 being lost or dropped in an inner volume 232. In some cases, the angle with the sidewall 230 can be between 0 and 180 degrees. In other cases, the angle with the sidewall 230 can be between 0 and 90 degrees. As shown in FIG. 2D, in some cases, the tab 202 can be removed or decoupled from the sidewall 230 in order to reposition the tab 202 from the first position to the second position. For example, the tab 202 can be cut off of the sleeve portion 204 such that the tab 202 is decoupled from the sleeve portion 204.

Figure 2B:
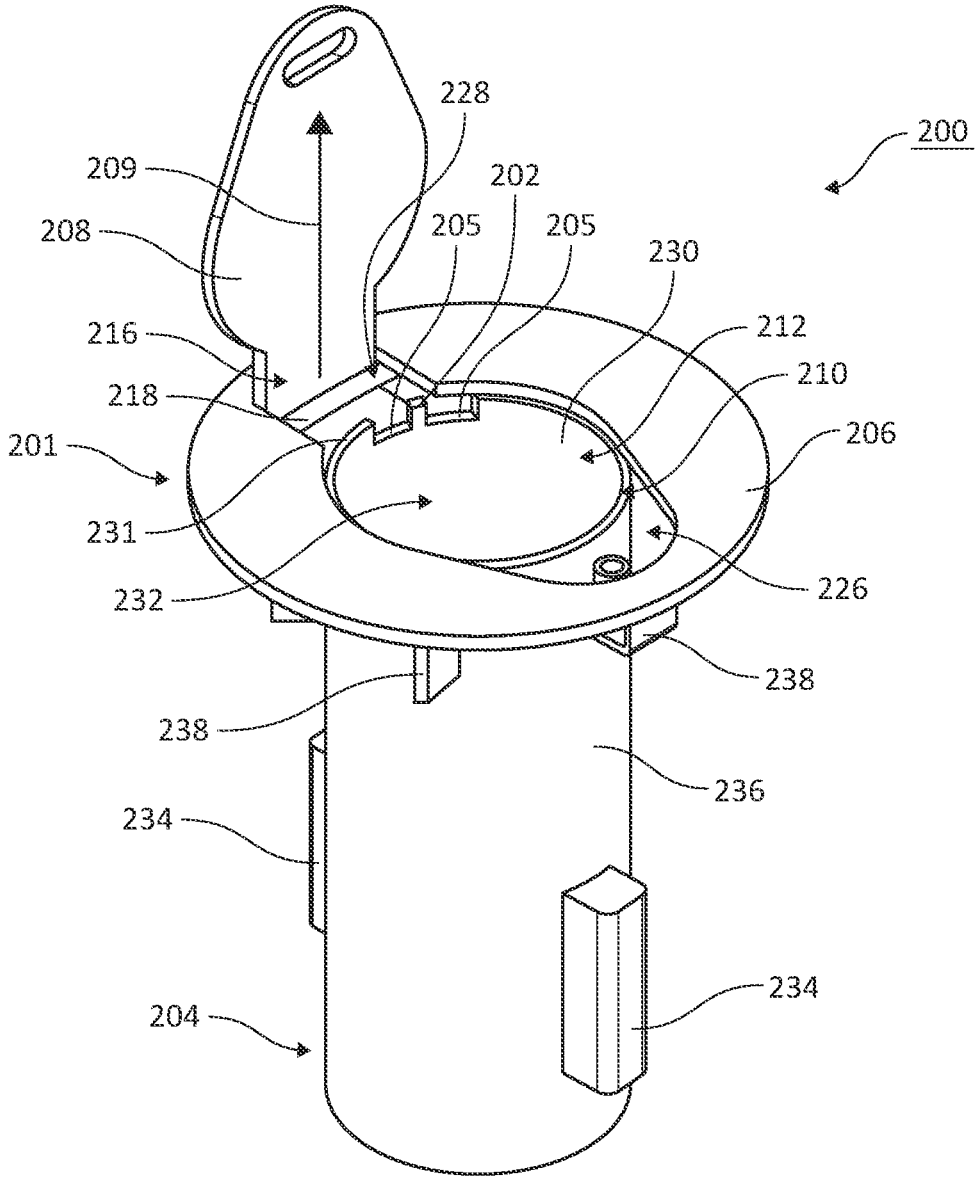
Figure 2C:
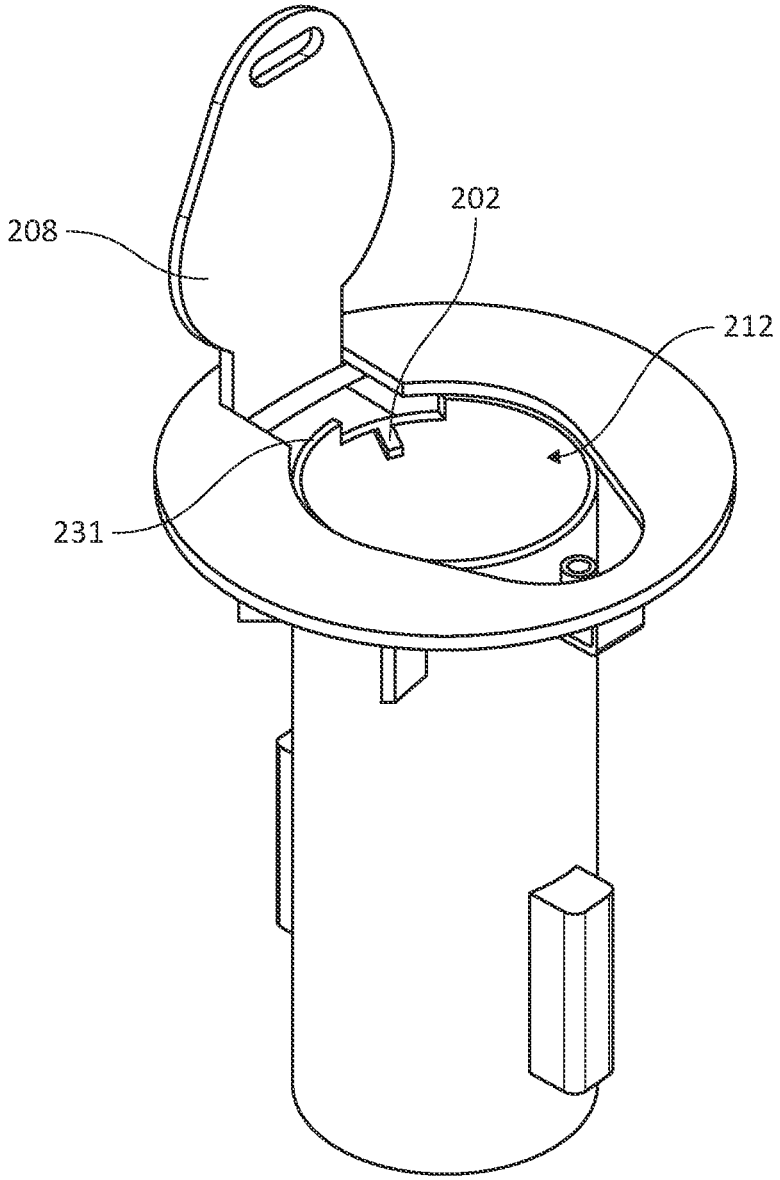
FIG. 2C illustrates an example of a bollard sleeve with a bent cover securement portion.
Figure 2D:
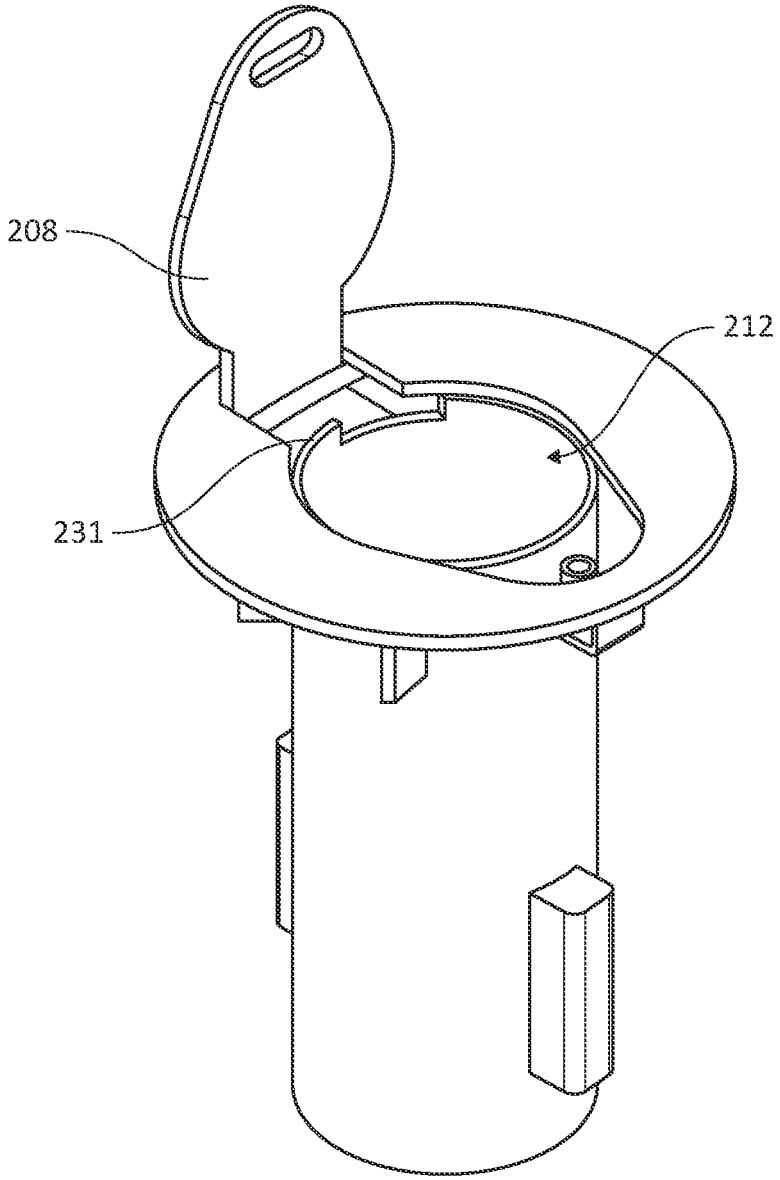
FIG. 2D illustrates an example of a bollard sleeve with a cover securement portion removed.

When the bollard is not in the bollard sleeve 200 and the tab 202 is in the second position the hinge 218 can be unobstructed by the border 231 and the tab 202, and the hinge 218 and the cover 208, as shown best is FIG. 2B, can be translated or rotated about a vertical axis 209 into the opening 212. Therefore, when the hinge 218 is in the opening 212 the hinge 218 may not contact the bottom surface 222 of the skirt 206 and the cover 208 can be removed from the rest of a top portion 201. In this way, the cover 208 can be removed from the bollard sleeve 200 when the bollard sleeve 200 is in the ground.

When the bollard sleeve 200 is supporting a bollard, the bollard may be hit by a vehicle or another heavy object damaging the cover 208. If the cover 208 is damaged or unusable, the cover 208 of the bollard sleeve 200 can be replaced with a new cover 208 that is undamaged, without removing the bollard sleeve 200 from the ground. To remove the cover, the cover can be moved to an open position, as shown in FIGS. 2A-2D. The tab 202 can be bent, as shown in FIG. 2C, or the tab 202 can be removed from the bollard sleeve 200, as shown in FIG. 2D. Once the tab 202 is bent or removed, the cover 208 can be rotated about the axis 209 shown in FIG. 2A, to move the hinge 218 across the border 231 and into the inner volume 232. In this way, the cover 208 can be lifted out of the inner volume 232 through the opening 212.

The hinge portion 216 of a new cover 208 can be inserted into the inner volume 232 through the opening 212. The new cover 208 can be rotated about the vertical axis 209 in a first direction and translated across the border 231 so the new cover 208 can be inserted into the hinge opening 228. The new cover 208 can be rotated in a second direction about the vertical axis 209 such that the hinge 218 contacts the bottom surface 222 of the skirt 206 and the new cover 208 is in the open position as shown in FIGS. 2A-2D. The second direction can be an opposite direction from the first direction.

If the tab 202 was bent to the second position, as shown in FIG. 2C, prior to removing the cover 208, the tab 202 can be bent back into the first position shown in FIGS. 2A, 2B and 4. In this way, the tab 202 can prevent the new cover 208 from being removed. In some cases, the tab 202 can be a cover securement portion. The cover securement portion can include any device or feature that prevents the cover 208 from being translated across the border 231 or otherwise secures the cover 308 within the hinge opening 228. In some cases, the tab 202 can be a screw, a pin or any other movable or rotatable component. In some cases, the cover securement portion can be coupled to the sleeve portion 204 or skirt 206. In some cases, the cover securement portion can be removably coupled to the sleeve portion 204 or skirt 206. In some cases, the cover securement portion can be coupled to the skirt 206 and the cover securement portion can be formed by one or more recesses or cutouts 205 in the skirt 206. The cover securement portion can be parallel to the bottom surface 222 of the skirt 206 when the securement portion is in the first position, and the securement portion can be bent at an angle relative to the bottom surface 222 of the skirt 206 when the securement portion is in the second portion. In some cases, the cover securement portion can include a lock. In some cases, the tab 202 or the cover securement portion coupled to the sidewall 230 can reduce the number of holes in the top portion 201 and thereby reduce tripping hazards.

Figure 3A:
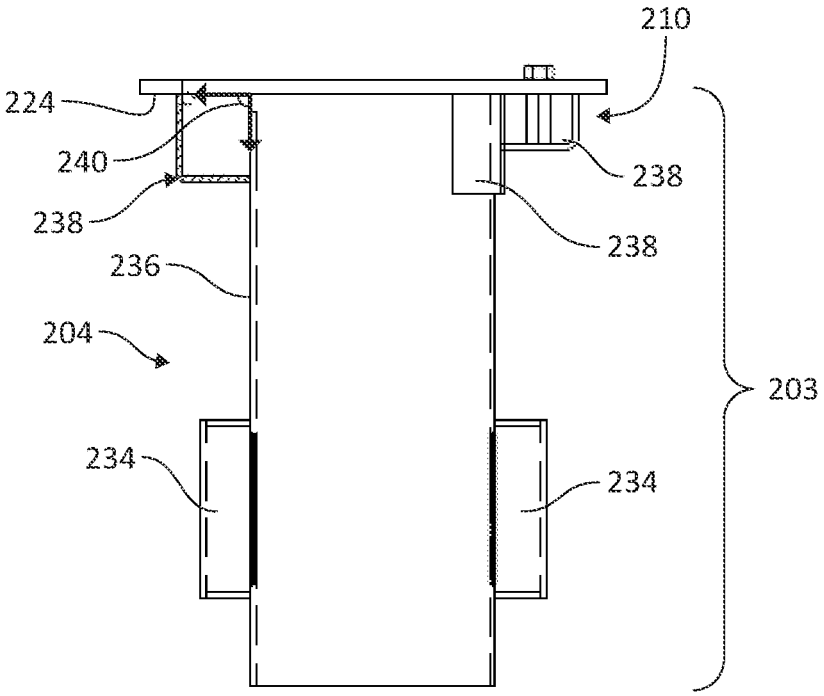
FIG. 3A illustrates a cross-section of an example of a bollard sleeve with a removable cover
Figure 3B:
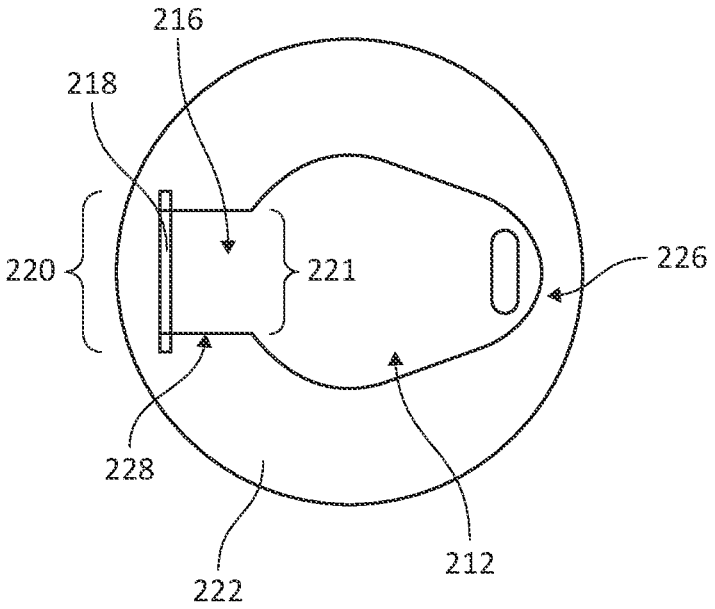
FIG. 3B illustrates a hinge of a bollard sleeve with a removable cover.

In some cases, as best shown in FIG. 3A, the sleeve portion 204 can include one or more locking cavities 234 coupled to an outer surface 236 of the sleeve portion 204. In some cases, the sleeve portion 104 can include two locking cavities 234. The locking cavities 234 can protrude radially outward from the sidewall 230 of the sleeve portion 204 and can be connected to the inner volume 232. The locking cavities 234 can be configured to receive a portion of the bollard such that when the portion of the bollard is inserted into the locking cavities 234, the locking cavities 234 may prevent the bollard from being removed from the inner volume 232 of the sleeve portion 204. In some cases, the portion of the bollard can include a cam lock or other locking feature.

In some cases, the bollard sleeve 200 can include one or more supports 238 as shown best in FIGS. 2B and 3A. The one or more supports 238 can be coupled to the outer surface 236 of the sleeve portion 204 and the bottom surface 222 of the skirt 206. The supports 238 can be configured to maintain the skirt 206 at an angle 240 with the outer surface 236 of the sleeve portion 204. In some cases, the angle 240 can be about 90 degrees. In this way, if a car or other heavy object applies a force to the skirt 206, the skirt 206 does not bend. In some cases, the supports 238 can cover or surround at least a portion of the hinge 218 and/or the nut 124 or lock. The support 28 can protect the hinge 218 and/or the nut 124 or lock when the bollard sleeve 200 is inserted into the ground.

In some cases, the sleeve portion 204 and the top portion 201 can include steel. In some cases, the sleeve portion 204 and the top portion 201 can include carbon steel and/or stainless steel. In some cases, the sleeve portion 204 and the top portion 201 can include schedule 10-1.180" stainless steel. In some cases, the entire bollard sleeve 200 can include one material. In other embodiments, the sleeve portion 204 and the top portion 201 can include different materials.

Although this disclosure has been described in the context of certain embodiments and examples, it will be understood by those skilled in the art that the disclosure extends beyond the specifically disclosed embodiments to other alternative embodiments and/or uses and obvious modifications and equivalents thereof. In addition, while several variations of the embodiments of the disclosure have been shown and described in detail, other modifications, which are within the scope of this disclosure, will be readily apparent to those of skill in the art. It is also contemplated that various combinations or sub-combinations of the specific features and configurations of the embodiments may be made and still fall within the scope of the disclosure. For example, features described above in connection with one embodiment can be used with a different embodiment described herein and the combination still fall within the scope of the disclosure. It should be understood that various features and configurations of the disclosed embodiments can be combined with, or substituted for, one another in order to form varying modes of the embodiments of the disclosure. Thus, it is intended that the scope of the disclosure herein should not be limited by the particular embodiments described above. Accordingly, unless otherwise stated, or unless clearly incompatible, each embodiment of this invention may comprise, additional to its essential features described herein, one or more features as described herein from each other embodiment of the invention disclosed herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a sub combination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some cases, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain configurations, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise. Additionally, as used herein, "gradually" has its ordinary meaning (e.g., differs from a non-continuous, such as a step-like, change).

The scope of the present disclosure is not intended to be limited by the specific disclosures of preferred embodiments in this section or elsewhere in this specification and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A bollard sleeve configured to receive a bollard, the bollard sleeve comprising:

a top portion comprising a skirt and a cover rotatably coupled to the skirt, wherein the cover extends through an opening in the skirt; and a sleeve portion coupled to the top portion, the sleeve portion comprising a sidewall and a cover securement portion, wherein the cover securement portion comprises a first position and a second position, and wherein the cover is non-removable when the cover securement portion is in the first position, and the cover is removeable when the cover securement portion is in the second position, and wherein the cover is configured to translate between the sidewall of the sleeve portion and a distal end of the opening opposite the sidewall of the sleeve portion when the cover securement portion is in the first position.

2. The bollard sleeve of claim 1, wherein the cover is removable when the sleeve portion is underground.

3. The bollard sleeve of claim 1, wherein the sleeve portion comprises a top end coupled to the top portion and a bottom end opposite the top end, and wherein the cover securement portion comprises a tab at the top end of the sleeve portion.

4. The bollard sleeve of claim 3, wherein the sleeve portion comprises a recess on either side of the tab, and a top of the tab is a same height as the top end of the sleeve portion.

5. The bollard sleeve of claim 3, wherein the cover comprises a hinge portion in contact with a bottom of the skirt, and the cover rotates about the hinge portion.

6. The bollard sleeve of claim 3, wherein the tab is substantially parallel to a sidewall of the sleeve portion when in the first position and the tab is bent at an angle to the sidewall when in the second position.

7. The bollard sleeve of claim 3, wherein the tab is coupled to the sleeve portion when in the first position and the tab is decoupled from the sleeve portion when in the second position.

8. The bollard sleeve of claim 1, further comprising at least one support coupled to the top portion and the sleeve portion.

9. The bollard sleeve of claim 1, further comprising at least one cavity coupled to the sleeve portion, the at least one cavity configured to receive a portion of a lock of the bollard, wherein the bollard is secured to the bollard sleeve when the at least one cavity receives the portion of the lock of the bollard.

10. The bollard sleeve of claim 1, wherein the bollard sleeve comprises at least one of steel, stainless steel, and/or carbon steel.

11. A bollard sleeve configured to receive a bollard, the bollard sleeve comprising:

a top portion comprising a skirt and a cover rotatably coupled to a bottom surface of the skirt; and a sleeve portion coupled to the top portion, the sleeve portion comprising a cover securement portion, wherein the cover securement portion is configured to bend between a first position and a second position, and wherein the cover is non-removable when the cover securement portion is in the first position, and the cover is removeable when the cover securement portion is in the second position.

12. The bollard sleeve of claim 11, wherein the cover securement portion comprises a tab, and wherein the sleeve portion comprises a recess on either side of the tab, and a top of the tab is a same height as a top end of the sleeve portion.

13. The bollard sleeve of claim 11, wherein the cover securement portion is substantially parallel to a sidewall of the sleeve portion in the first position, and the cover securement portion is bent at an angle in the second position.

14. The bollard sleeve of claim 11, wherein a sidewall of the sleeve portion is substantially vertical when the cover securement portion is in the second position to prevent the cover from being removed without rotating the cover about a vertical axis.

15. The bollard sleeve of claim 11, further comprising at least one cavity coupled to the sleeve portion, the at least one cavity configured to receive a portion of a lock of the bollard, wherein the bollard is secured to the bollard sleeve when the at least one cavity receives the portion of the lock of the bollard.

16. A method of replacing a bollard sleeve cover comprising:

bending a cover securement portion of a sleeve portion of a bollard sleeve from a first position to a second position;

releasing a portion of the bollard sleeve cover from a skirt portion of the bollard sleeve;

removing the bollard sleeve cover through an opening configured to receive a bollard;

inserting a second bollard sleeve cover through the opening; and securing the second bollard sleeve cover to the skirt portion of the bollard sleeve.

17. The method of claim 16, wherein the cover securement portion comprises a tab.

18. The method of claim 17, wherein the tab is substantially vertical when in the first position and the tab is bent when in the second position.

19. The method of claim 18, further comprising moving the cover securement portion from the second position to the first position.

20. The method of claim 16, wherein a sidewall of the sleeve portion is substantially vertical when the cover securement portion is in the second position to prevent the cover from being removed without rotating the cover about a vertical axis, and wherein releasing the portion of the bollard sleeve cover comprises rotating the bollard sleeve cover about the vertical axis.

21. The method of claim 20, wherein securing the second bollard sleeve cover comprises rotating the second bollard sleeve cover about the vertical axis.

* * * * *